US011313055B2

(12) United States Patent
Perrin

(10) Patent No.: US 11,313,055 B2
(45) Date of Patent: Apr. 26, 2022

(54) FABRIC AND GARMENT INCLUDING COMPRESSION ZONES AND METHOD FOR PRODUCING SUCH A FABRIC

(71) Applicant: Perrin & Fils, Le Grand-Lemps (FR)

(72) Inventor: Sébastien Perrin, Le Grand-Lemps (FR)

(73) Assignee: PERRIN & FILS, Le Grand-Lemps (FR)

( * ) Notice: Subject to any disclaimer, the term of this patent is extended or adjusted under 35 U.S.C. 154(b) by 1255 days.

(21) Appl. No.: 15/324,459

(22) PCT Filed: Jun. 16, 2015

(86) PCT No.: PCT/FR2015/051593
§ 371 (c)(1),
(2) Date: Jan. 6, 2017

(87) PCT Pub. No.: WO2016/005670
PCT Pub. Date: Jan. 14, 2016

(65) Prior Publication Data

US 2017/0204542 A1 Jul. 20, 2017

(30) Foreign Application Priority Data

Jul. 11, 2014 (FR) ..... 1456732

(51) Int. Cl.
*D03D 11/02* (2006.01)
*D03D 13/00* (2006.01)
(Continued)

(52) U.S. Cl.
CPC ..... *D03D 11/02* (2013.01); *D03D 13/004* (2013.01); *D03D 15/56* (2021.01); *D10B 2501/00* (2013.01)

(58) Field of Classification Search
CPC ..... D03D 11/02; D03D 13/004; D03D 15/08; D03D 15/56; D10B 2501/00
See application file for complete search history.

(56) References Cited

U.S. PATENT DOCUMENTS 2,196,957 A 4/1940 Cosman
2,269,321 A 1/1942 Scheuer
(Continued)

FOREIGN PATENT DOCUMENTS

CN 203683814 U 7/2014
FR 2890083 A1 3/2007
(Continued)

*Primary Examiner* — Robert H Muromoto, Jr.
(74) *Attorney, Agent, or Firm* — Harness, Dickey & Pierce PLC

(57) ABSTRACT

A pocket fabric and a method for producing such a fabric, include elastic warp threads and elastic weft threads, and include one or more pockets having at least two stacked layers of fabric in which the warp threads result from the division of the warp threads of a single warp. The at least two layers of fabric are connected to one another by one or more woven joining areas in which the warp thread or threads result from joining the layers of fabric into a single warp, one or more of the at least two layers of fabric including a plurality of weaves with different elasticities, the weaves defining areas having different elasticities in the woven pocket fabric. A garment made of the fabric or including the fabric is also disclosed.

14 Claims, 3 Drawing Sheets

(51) Int. Cl.
*D03D 15/56* (2021.01)
*A41D 27/20* (2006.01)

(56) References Cited

U.S. PATENT DOCUMENTS

| | | | | |
|---|---|---|---|---|
| 6,085,802 | A * | 7/2000 | Silberberg | A62B 35/04 139/387 R |
| 7,117,900 | B2 | 10/2006 | Lam et al. | |
| 7,159,621 | B2 * | 1/2007 | Shannon | D04B 1/18 139/422 |
| 7,216,678 | B2 * | 5/2007 | Baer | D03D 13/004 139/384 R |
| 7,406,986 | B2 | 8/2008 | Lam | |
| 7,575,027 | B2 * | 8/2009 | Huang | D03D 15/54 139/420 R |
| 7,644,738 | B2 * | 1/2010 | Kroll | D03D 13/004 139/383 A |
| 8,136,555 | B1 * | 3/2012 | Chang | D03D 1/0005 139/383 R |
| 8,567,559 | B2 * | 10/2013 | Russell | D03D 11/00 182/3 |
| 9,422,666 | B2 * | 8/2016 | Patel | D21F 1/0027 |
| 9,637,845 | B2 * | 5/2017 | Morales | D03D 1/00 |
| 9,790,625 | B2 * | 10/2017 | Hussey | D03D 15/08 |
| 9,854,853 | B2 * | 1/2018 | Musciacchio | A41D 7/005 |
| 9,938,646 | B2 * | 4/2018 | Hamada | D03D 49/04 |
| 10,060,054 | B2 * | 8/2018 | Weening | D03D 15/513 |
| 10,092,805 | B2 * | 10/2018 | Morrow | B29C 45/14786 |
| 2003/0130603 | A1 * | 7/2003 | Minne | A41D 13/0531 602/19 |
| 2005/0189169 | A1 | 9/2005 | Tanaka et al. | |
| 2006/0219249 | A1 * | 10/2006 | Czajka | A61B 46/00 128/849 |
| 2012/0161376 | A1 | 6/2012 | Hede | |
| 2013/0019375 | A1 * | 1/2013 | Roman | A63B 71/1225 2/69 |
| 2013/0160187 | A1 * | 6/2013 | Crutcher | A42B 1/245 2/181 |
| 2015/0351473 | A1 * | 12/2015 | Roman | A41D 27/00 2/69 |
| 2016/0219944 | A1 * | 8/2016 | Berns | A41D 1/06 |

FOREIGN PATENT DOCUMENTS

| | | | |
|---|---|---|---|
| GB | 607228 | A | 8/1948 |
| WO | WO-2010/043868 | A2 | 4/2010 |

* cited by examiner

| | | | | | | | |
|---|---|---|---|---|---|---|---|
| B | B | B | B | B | B | B | B |
| B | B | B | B | B | B | B | B |
| B | B | B | B | B | B | B | B |
| B | B | B | B | B | B | B | B |
| B | B | B | B | B | B | B | B |
| B | B | B | B | B | B | B | B |
| B | B | B | B | B | B | B | B |
| B | B | B | B | B | B | B | B |

a

| | | | | | | | |
|---|---|---|---|---|---|---|---|
| B | B | B | B | B | A | B | B |
| B | B | A | B | B | B | B | B |
| B | B | B | B | B | B | B | A |
| B | B | B | B | A | B | B | B |
| B | A | B | B | B | B | B | B |
| B | B | B | B | B | B | A | B |
| B | B | B | A | B | B | B | B |
| A | B | B | B | B | B | B | B |

b

| | | | | | | | |
|---|---|---|---|---|---|---|---|
| | B | B | B | B | A | A | B |
| B | B | A | A | B | B | B | B |
| A | B | B | B | B | B | B | A |
| B | B | B | B | A | A | B | B |
| B | A | A | B | B | B | B | B |
| B | B | B | B | B | B | A | A |
| B | B | B | A | A | B | B | B |
| A | A | B | B | B | B | B | B |

c

| | | | | | | | |
|---|---|---|---|---|---|---|---|
| B | B | B | B | B | A | A | A |
| B | B | A | A | A | B | B | B |
| A | A | B | B | B | B | B | A |
| B | B | B | B | A | A | A | B |
| B | A | A | A | B | B | B | B |
| A | B | B | B | B | B | A | A |
| B | B | B | A | A | A | B | B |
| A | A | A | B | B | B | B | B |

d

| | | | | | | | |
|---|---|---|---|---|---|---|---|
| A | B | B | B | B | A | A | A |
| B | B | A | A | A | A | B | B |
| A | A | A | B | B | B | B | A |
| B | B | B | B | A | A | A | A |
| B | A | A | A | A | B | B | B |
| A | A | B | B | B | B | A | A |
| B | B | B | A | A | A | A | B |
| A | A | A | A | B | B | B | B |

e

| | | | | | | | |
|---|---|---|---|---|---|---|---|
| A | A | B | B | B | A | A | A |
| B | B | A | A | A | A | A | B |
| A | A | A | A | B | B | B | A |
| A | B | B | B | A | A | A | A |
| B | A | A | A | A | A | B | B |
| A | A | A | B | B | B | A | A |
| B | B | B | A | A | A | A | A |
| A | A | A | A | A | B | B | B |

f

| | | | | | | | |
|---|---|---|---|---|---|---|---|
| A | A | A | B | B | A | A | A |
| B | B | A | A | A | A | A | A |
| A | A | A | A | A | B | B | A |
| A | A | B | B | A | A | A | A |
| B | A | A | A | A | A | A | B |
| A | A | A | A | B | B | A | A |
| A | B | B | A | A | A | A | A |
| A | A | A | A | A | A | B | B |

g

| | | | | | | | |
|---|---|---|---|---|---|---|---|
| A | A | A | A | B | A | A | A |
| A | B | A | A | A | A | A | A |
| A | A | A | A | A | A | B | A |
| A | A | A | B | A | A | A | A |
| B | A | A | A | A | A | A | A |
| A | A | A | A | A | B | A | A |
| A | A | B | A | A | A | A | A |
| A | A | A | A | A | A | A | B |

h

| | | | | | | | |
|---|---|---|---|---|---|---|---|
| A | A | A | A | A | A | A | A |
| A | A | A | A | A | A | A | A |
| A | A | A | A | A | A | A | A |
| A | A | A | A | A | A | A | A |
| A | A | A | A | A | A | A | A |
| A | A | A | A | A | A | A | A |
| A | A | A | A | A | A | A | A |
| A | A | A | A | A | A | A | A |

i

Fig. 6

FABRIC AND GARMENT INCLUDING COMPRESSION ZONES AND METHOD FOR PRODUCING SUCH A FABRIC

CROSS-REFERENCE TO RELATED APPLICATIONS

This application is a National Phase Entry of International Patent Application No. PCT/FR2015/051593, filed on Jun. 16, 2015, which claims priority to French Patent Application Serial No. 1456732, filed on Jul. 11, 2014, both of which are incorporated by reference herein.

TECHNICAL FIELD

The present invention relates to the field of weaving and relates to a pocket fabric comprising areas with different elasticities, and a garment comprising the pocket fabric and a method for manufacturing such a pocket fabric.

BACKGROUND

Weaving is a well known technique for manufacturing fabrics or cloths, which consists of the intertwining of at least two series of threads, a first series forming a warp and a second forming a weft, the intersection mode being defined by a code referred to as the weave. The graphical representation of weaves comprises a matrix in which the vertical columns represent the warp threads and the horizontal rows designate the weft threads or picks. When a warp thread passes over a pick, the corresponding box is coloured and the thread is then said to be "taken" whereas when the pick passes over the warp thread the box is not coloured and the thread is then said to be "left".

There exist three so-called "ground" weaves since they serve as a basis for composing complex weaves. These are the "plain" weave, the "twill" weave and the "satin" weave.

The plain weave is obtained by passing each weft thread alternately over and under each warp thread (FIG. 1). For this weave, the weave ratio R (representing the number of warp and weft threads necessary for reproduction thereof, that is to say the number of threads and picks after which the weave repeats itself) is equal to two (two warp threads for two weft threads), with a step number (representing the gradation of the binding of the threads with the picks as the weaving progresses) that is equal to 1.

The twill weave is obtained by the intersecting of a warp thread every two picks or more, each pick being offset by one thread with respect to the previous one. The weave ratio R is a minimum of 3; there is always a step number of 1. It is possible to weave the twill weave on 2, 3 or 4 frames. For a 3/1 twill, or 3 binds 1 (FIG. 2), the warp thread passes alternately under 3 weft threads and then over 1 weft thread. For a 2/2 twill weave, the warp chain passes alternately under 2 weft threads and then over 2 weft threads. For a 1/3 twill weave, the warp thread passes alternately under 1 weft thread and then over 3 weft threads.

Satin weave has only one binding point on each warp thread and on each pick of the weave ratio. From these ground weaves, it is possible to obtain derived weaves, such as for example "gassed" weave (FIG. 4) or "honeycomb" weave (FIG. 5), which are obtained by adding to a ground weave additional warp and/or weft risers, by addition, interposing, transposition, superimposition, juxtaposition or radiation. It is also possible to obtain weaves composed by the juxtaposition of two or more different weaves.

Conventionally, a fabric is woven in two dimensions, on a linear loom, by interleaving the warp threads and the weft threads in a single plane in order to form a single piece of flat fabric. However, there also exist so-called "tubular" fabrics, which are knitted fabrics and are manufactured on circular knitting looms in order to obtain a piece of fabric in three dimensions, in this case a tube.

There also exist so-called "pocket" fabrics, which are pieces of flat fabric comprising pockets connected to the rest of the piece of fabric by weaving. These are fabrics that are manufactured not on circular looms but on linear looms of the Jacquard type. These fabrics are obtained by periodically dividing the warp threads into two separate warps, superimposed one on the other, woven concomitantly in order to form pockets, and then the threads of the two warps are, intermittently, once again then joined in a single warp that is woven, thus forming the connection fabric between the pockets. Generally, whatever the type of fabric that is woven, it is obtained by the intersection of threads according to a single type of weave, whether it be ground, compound or derived, and then the fabric is cut according to a pattern in order to form all or part of a garment, parts that are next assembled by stitching or thermal welding.

Moreover, manufacturing elastic garments is known, using elastic fabrics manufactured using elastic weft and/or warp threads, or compression-effect garments that comprise various pieces of fabrics with different elasticities assembled by stitching or thermal welding, or by the addition of compression strips bonded or stitched onto a support fabric. These articles are particularly useful in the medical or sports field, since compression effects make it possible to improve the blood circulation of the wearer of the garment or to afford, during practice of an activity, for example sporting, which comprises the repetition of particular movements, a reduction in fatigue and better physical and physiological recovery while ensuring the maintenance of muscular masses and joints.

Nevertheless, these solutions have the drawback of requiring a large number of manufacturing operations when such fabrics are assembled. Moreover, they have stitches which may be sources of heating or injury. In addition, with regard to the supplementary strips on a basic fabric, the article has a protrusion that is uncomfortable and a source of heat when practising a physical activity.

SUMMARY

The present invention aims to provide a pocket fabric, a garment and a method for manufacturing such a fabric and such a garment, which do not have the drawbacks of the prior art. The present invention aims to provide a solution that is an alternative to current fabrics and garments and the existing methods of manufacturing same. The present invention aims to provide a solution that is easy to implement and makes it possible to modulate the transverse and longitudinal compression effect on particular areas of the body stressed during a given physical activity.

The present invention relates to a pocket fabric comprising elastic warp threads and elastic weft threads and comprising one or more pockets comprising at least two superimposed layers of fabric, the warp threads of which result from the division of the warp threads of a single warp, the at least two layers of fabric being connected together by one or more woven joining areas in which the warp threads result from the joining of the fabric layers again in a single warp, one of and/or the at least two layers of fabric comprising a plurality of weaves with different elasticities, the weaves defining areas with different elasticities in said woven pocket fabric. According to preferred embodiments of the invention, the pocket fabric according to the invention comprises at least one, or any suitable combination, of the following features:

- one of the at least two layers of fabric comprises a plurality of weaves having elasticities different from those of the plurality of weaves of another of the at least two layers of fabric,
- one of and/or the at least two layers of superimposed fabric comprise a combination of plain weave with twill weave,
- the plurality of weaves with different elasticities of one of and/or the at least two layers of fabric, and/or the woven joining area or areas, comprise a joining weave that comprises a combination of the weaves to be joined,
- the at least two superimposed layers of fabric and/or the joining area or areas between said at least two layers of fabric comprise one or more weaves with different elasticities embedded in a base weave,
- the woven joining area or areas serves or serve as a finishing for the edges of said pocket fabric,
- said elastic threads are threads based on elastothane.

The present invention also relates to a method for obtaining a fabric according to the invention, the method comprising the steps of taking elastic warp threads and elastic weft threads, dividing the warp threads at least once into at least two secondary warps, weaving the threads of the at least two secondary warps in a first weave with a given elasticity, and then, without interrupting the weaving, weaving the threads of the at least two secondary warps in a second weave, or a plurality of other weaves, having one or more elasticities different from said first weave in order to form areas with different elasticities at defined points on the pocket fabric, and then at least once joining the threads of the at least two secondary warps in a single warp in order to form at least one woven joining area and to form at least one pocket.

According to preferred embodiments of the invention, the method according to the invention comprises at least one, or any suitable combination, of the following features:

- the first weave, the second weave or the plurality of other weaves of one of the at least two secondary warps comprise an elasticity different from that of the first weave, of the second weave or of the plurality of other weaves, of another of the at least two secondary warps,
- said joining, of the first weave to the second weave or to the plurality of weaves, being done by weaving the elastic threads in a joining weave that comprises a combination of weaves to be joined,
- the weaving of the first weave, of the second weave or of the plurality of other weaves is done in a predetermined pattern.

The present invention also relates to an article made from the woven fabric, or comprising the woven fabric, according to the invention. In a particular embodiment of the garment, the latter is a garment for practising a sport.

BRIEF DESCRIPTION OF THE FIGURES

FIG. 6 is a schematic representation of joining weaves a) to i) for passing from a first weave "A" to a weave "B".

DETAILED DESCRIPTION

Figure 1:
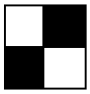
FIG. 1 is a schematic representation of the so-called plain ground weave.
Figure 2:
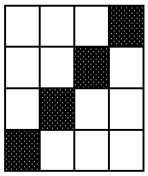
FIG. 2 is a schematic representation of the so-called twill ground weave.
Figure 3:
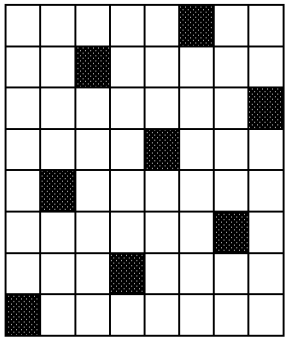
FIG. 3 is a schematic representation of the so-called satin ground weave.
Figure 4:
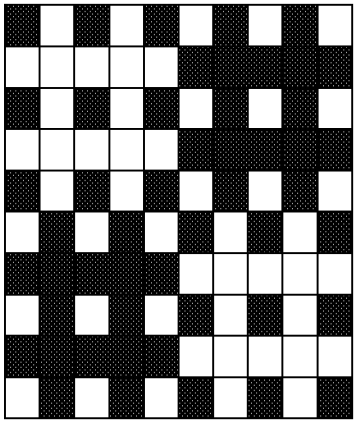
FIG. 4 is a schematic representation of the gassed derived weave.
Figure 5:
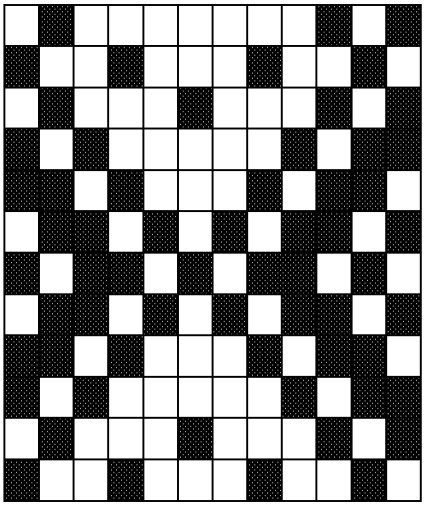
FIG. 5 is a schematic representation of the honeycomb derived weave.

The fabric according to the present invention is a pocket fabric, woven from a single piece, obtained by weaving elastic Warp threads and elastic weft threads. In the present description of the invention, the term "elastic" must be understood as covering materials that are extensible in the direction of stressing and allowing return to their initial shape. The elastic threads forming the fabric are made from elastic fibres, such as for example elastothane fibres, or made from a natural or synthetic non-elastic fibre covered with a material or composition for conferring elasticity properties, or comprising non-elastic fibres assembled or twisted with elastic fibres or non-elastic fibres covered with an elastic material, in order to form a thread having elasticity properties.

The pocket fabric according to the invention comprises one or more pockets, each pocket comprising at least two layers of fabric, the Warp threads of which come from threads of the same single main Warp that has been divided into at least two secondary warps, the secondary warps being woven concomitantly. The pockets thus woven are closed again by joining the layers of fabric to each other by weaving, joining the threads of the secondary warps into a single Warp. The pocket fabric according to the invention may comprise a multitude of pockets alongside one another. Moreover, the pockets may, independently of one another, comprise 2, 3 or a multitude of layers of fabric, which makes it possible to obtain a fabric, one or more portions of which comprise pockets superimposed on one another, or pockets overlapping. For this, the threads of the main Warp are divided into a plurality of secondary warps, which are woven concomitantly, and then joined to one another, by weaving, joining the threads of a secondary Warp to another secondary Warp and/or joining all the threads of the secondary warps in a single Warp.

In the pocket fabric according to the invention, one and/or the at least two layers, advantageously a multitude of layers, comprise one or a multitude of areas with different elasticities, obtained using different weaves having different elasticities, this using identical or different elastic threads, for the weft and the Warp of these various weaves. The areas with different elasticities may be disposed symmetrically, or asymmetrically, unilaterally or bilaterally, from one layer of fabric to one or more others. It is thus possible to modulate the elasticity of a pocket fabric in different areas. Preferably, the areas with different elasticities, and therefore the weaves having different elasticities, are disposed in a predetermined scheme according to the garment that will be made from such a fabric, and in particular according to the predetermined localised compression areas.

A first layer of fabric forming a pocket may comprise one type of weave or a succession of weaves with different elasticities, the second layer, or the other layers of fabric, comprising the same type of weave or succession of weaves with different elasticities, or another type of weave or succession of weaves with different elasticities having one or more elasticities different from that of those of the first layer of fabric. By way of example, the elasticity of various weaves, comprising elastic threads of the same type, for example elastothane threads known by the trade name "Lycra®" (registered trade mark) from the company DuPont, has been studied and the results are given in Tables 1 and 2.

TABLE 1

| | Plain weave | | | Twill weave | | |
|---|---|---|---|---|---|---|
| | Test no. | Modulus at 40% (N) | Maximum % deformation (%) | Test no. | Modulus at 40% (N) | Maximum % deformation (%) |
| Warp | 1 | 9.26 | 52.1 | 1 | 6.31 | 76.5 |
| | 2 | 9.43 | 52.2 | 2 | 5.93 | 78.7 |
| | 3 | 9.35 | 51.1 | 3 | 5.87 | 79.2 |
| Weft | 4 | 8.14 | 55.1 | 4 | 5.29 | 82.8 |
| | 5 | 8.01 | 56.2 | 5 | 5.20 | 81.0 |
| | 6 | 7.60 | 57.2 | 6 | 5.45 | 79.7 |
| Mean | | 8.63 | 53.8 | | 5.68 | 79.7 |
| Standard deviation | | 0.80 | 2.7 | | 0.43 | 2.1 |

TABLE 2

| | Satin weave | | | Gassed weave | | |
|---|---|---|---|---|---|---|
| | Test no. | Modulus at 40% (N) | Maximum % deformation (%) | Test no. | Modulus at 40% (N) | Maximum % deformation (%) |
| Warp | 1 | 4.18 | 112.9 | 1 | 5.58 | 84.3 |
| | 2 | 4.53 | 108.0 | 2 | 5.35 | 87.0 |
| | 3 | 4.58 | 106.3 | 3 | 5.43 | 86.3 |
| Weft | 4 | 6.33 | 105.9 | 4 | 5.01 | 89.8 |
| | 5 | 4.51 | 108.3 | 5 | 5.50 | 101.6 |
| | 6 | 4.67 | 104.4 | 6 | 4.71 | 92.2 |
| Mean | | 4.80 | 107.6 | | 5.26 | 90.2 |
| Standard deviation | | 0.77 | 3.0 | | 0.33 | 6.2 |

The tests were carried out on a fabric woven by means of threads known by the trade name Lycra® (registered trade mark) of 44 decitex (or dtex), that is to say 44×10-7 kg/m, the Warp of which has a density of 74 threads to the centimetre and the weft 66 threads to the centimetre. The tests consist firstly of measuring the force necessary for obtaining 40% elongation of the Warp or weft, and secondly measuring the maximum elongation (% of maximum deformation) obtained for two cycles of stretching the Warp or weft with a force of 15 newtons. The elasticity of a fabric certainly results from the use or not of elastic Warp and/or weft threads, but it also appears that the type of weave used influences the final elasticity of the fabric.

By way of example, the fabric according to the invention may comprise a succession of plain weaves and twill weaves, or a succession of plain weaves, twill weaves and honeycomb weaves. In the woven fabric, the areas with different elasticities follow one another and are disposed adjacent to one another, the passage from one to another taking place continuously, directly on the loom, or by means of a joining weave in order to produce a joining fabric area, which has the advantage of allowing gradual transition from one elasticity to another. Preferably, the joining weave between weaves comprises a combination of the weaves with different elasticities that are to be joined.

By way of example, as shown in FIG. 6, the passage from a portion of the fabric comprising a weave "B" having a given elasticity, for example a plain weave, to a fabric comprising a weave "A" having another given elasticity, for example a satin weave, is done by weaving a fabric according to a weave comprising the weave "B" and also the weave "A". Preferably, the area of fabric forming the junction between two portions of fabric comprises a combination of 0% (FIG. 6 *a*), 25%, 50%, 75% and then 100% of weave "A" (FIG. 6 *i*). The layers forming the pocket or pockets are joined by weaving, preferably by means of a joining weave, which may be one of the weaves of one of or at least two of the layers of fabric of the pocket or pockets, or a particular joining weave.

Preferably, the layers of fabric forming the pockets and/or the joining areas between the pockets comprise a base weave in which one or more other weaves with different elasticities is or are embedded. These weaves are preferably incorporated according to a defined location. The base weave and the weaves with different elasticities are ground weaves, derived weaves or compound weaves.

The method for manufacturing the fabric according to the invention comprises the weaving of elastic threads of a single Warp which, after a first weaving in a first weave, is periodically divided into at least two secondary warps, in order to form one or more pockets. The weaving of the at least two warps is concomitant and is done according to a first weave having a given elasticity, and then, without interrupting the weaving, according to a second weave, or a plurality of other weaves, having one or more elasticities different from said first weave. The weaving of the weaves with different elasticities can be done on one or other or both or a plurality of the at least two warps symmetrically, asymmetrically, unilaterally or bilaterally, from one layer of fabric to the other or others.

The passage from one weave with different elasticities to another may be done, on one or other or both or a plurality of the at least two warps, by means of a joining weave in order to produce a joining weave area, which has the advantage of affording a gradual transition from one elasticity to another. Preferably, the joining weave between weaves comprises a combination of the weaves with different elasticities that are to be joined.

The method for manufacturing the fabric according to the invention comprises the joining again, at least once, preferably periodically, of the Warp threads in a single Warp, in order to form one or more woven joining areas and thus form at least one pocket, preferably a plurality of pockets. Preferably, the woven joining area or areas comprise a joining weave that comprises a combination of the weaves to be joined. The method for manufacturing the fabric according to the invention has the advantage of affording total freedom in the placing of the areas with different elasticities upstream of the process of manufacturing the fabric or of the garment, as well as perfect integration in the fabric of the areas with different elasticities.

The garment according to the present invention comprises, or is made from, the woven fabric according to the present invention. The garment has the advantage of comprising compression areas, advantageously located in the garment to make it possible to improve the blood circulation and/or reduce fatigue and to ensure better physical and physiological recovery while maintaining the muscular masses and the joints, during the practice of a physical activity, while having improved comfort because of the absence of stitches between the various areas with different elasticities.

The garment is elastic in the direction of the Warp and weft. It is elastic in the transverse and longitudinal directions of the body wearing it or body element in question, a limb or torso for example. It further comprises areas with different elasticities, transverse and/or longitudinal, according to the areas of the body or body element wearing the article. Body elements means the head, the torso, a lower and/or upper limb, the thigh, leg, feet, arms, forearms and hands.

The garment comprises a main part having a given elasticity made from or comprising a woven fabric comprising elastic Warp threads and elastic weft threads according to one or more ground, derived or compound weaves, and compression areas comprising a woven fabric comprising elastic Warp threads and elastic weft threads according to one or more ground, derived or compound weaves having elasticities different from those of the main part. Preferably, the garment comprises one or more openings to allow passage of the body intended to wear it or of one or more body elements. Preferably, these openings comprise means for closing the garment around the body or body elements obtained by weaving the elastic Warp and weft threads in a weave having an elasticity different from the plurality of weaves from which the garment is made. It is, for example for shorts, a belt woven in a weave having elasticity different from the plurality of weaves making up the garment, enabling the shorts to grip the waist of the person wearing the shorts.

Preferably, the edges of the garment are made from or comprise a woven weave known as an edge finishing weave, advantageously having elasticity different from the weaves used for the main part of the garment, and even more advantageously having elasticity identical to that of the means for closing the garment around the body or body elements. By way of example, the main part of the garment comprises the plain weave and the twill weave, whereas the belt and the edges of the legs in the case of shorts or the neck and the edges of the sleeves in the case of a t-shirt, comprise a honeycomb weave. The fabric according to the invention has the additional advantage of having the pocket-joining weave that serves as an edge finishing. By way of example, this joining weave may be a plain or twill weave.

Preferably, the garment is an item of clothing, preferably clothing for the bottom and/or top of the body, for example a lingerie article, a long- or short-sleeved t-shirt, a tank top, shorts, a leotard, a swimsuit, tights, or a ski, skating or bobsleigh combination, but it may also be a case of gloves, a bonnet, a mask, a cagoule or socks. Advantageously, it is a garment for practising a sport, such as for example swimming, surfing, cycling, walking or running. Preferably, the garment is a t-shirt or a combination comprising areas with different elasticities at the pectorals and/or vertebral column. Preferably, the garment is shorts comprising areas with different elasticities at the thighs and/or genital parts and/or the crotch.

The invention claimed is:

1. A pocket fabric comprising:

elastic warp threads and elastic weft threads;

one or more pockets comprising at least two superimposed layers of the fabric, the warp threads of which result from a division of the warp threads of a single warp;

the at least two layers of the fabric being connected together by one or more woven joining areas in which the warp threads result from joining of the fabric layers again in a single warp;

one of and/or the at least two layers of the fabric comprising a plurality of weaves with different elasticities, the weaves defining areas with different elasticities in the woven pocket fabric; and a first of the at least two layers of the fabric comprising a plurality of weaves having elasticities different from those of the plurality of the weaves of a second of the at least two layers of the fabric.

2. The pocket fabric according to claim 1, wherein the one and/or the at least two superimposed layers of the fabric comprise a combination of a plain weave with a twill weave.

3. The pocket fabric according to claim 1, wherein the plurality of the weaves with the different elasticities of the one and/or the at least two layers of the fabric, and/or the woven joining area or areas, comprise a joining weave that comprises a combination of the weaves to be joined.

4. The pocket fabric according to claim 1, wherein the at least two superimposed layers of the fabric and/or the joining area or areas between the at least two layers of the fabric comprise one or more weaves with the different elasticities embedded in a base weave.

5. The pocket fabric according to claim 1, wherein the woven joining area or areas serves or serve as finishing for edges of the pocket fabric.

6. The pocket fabric according to claim 1, wherein the elastic threads are threads based on elastothane.

7. A method for obtaining a pocket fabric comprising:

(a) taking elastic warp threads and elastic weft threads;

(b) dividing the warp threads at least once into at least two secondary warps;

(c) weaving the threads of the at least two secondary warps in a first weave with a given elasticity, and then;

(d) without interrupting the weaving, weaving the threads of the at least two secondary warps in a second weave, or a plurality of other weaves, having one or more elasticities different from the first weave in order to form areas with different elasticities at defined points on the pocket fabric; and (e) at least once joining the threads of the at least two secondary warps in a single warp in order to form at least one woven joining area and to form at least one pocket.

8. The method according to claim 7, in which the first weave, the second weave or the plurality of other weaves of one of the at least two secondary warps comprise an elasticity different from that of the first weave, the second weave or the plurality of other weaves, of another one of the at least two secondary warps.

9. The method according to claim 7, wherein the joining of the first weave to the second weave or to the plurality of weaves is done by weaving the elastic threads in accordance with a joining weave that comprises a combination of the weaves to be joined.

10. The method according to claim 7, wherein the weaving of the first weave, of the second weave or of the plurality of other weaves is done in accordance with a predetermined pattern.

11. A garment comprising:

a woven fabric or a woven pocket fabric, the fabric comprising elastic warp threads and elastic weft threads;

one or more pockets comprising at least two superimposed layers of the fabric, the warp threads of which result from a division of the warp threads of a single warp;

the at least two layers of the fabric being connected together by one or more woven joining areas in which the warp threads result from joining of the fabric layers again in a single warp;

one of and/or the at least two layers of the fabric comprising a plurality of weaves with different elasticities, the weaves defining areas with different elasticities in the woven pocket fabric; and a first of the at least two layers of the fabric comprising a plurality of weaves having elasticities different from those of the plurality of the weaves of a second of the at least two layers of the fabric.

12. The garment according to claim 11, being an article of clothing for practising a sport.

13. The garment according to claim 11, being shorts with the areas of the different elasticities in at least one of: a thigh area, a genital area, and a crotch area.

14. The garment according to claim 11, being a shirt with the areas of the different elasticities in at least one of: a pectoral area and a vertebral column area.

* * * * *